US006198439B1

(12) United States Patent
Dufrane et al.

(10) Patent No.: US 6,198,439 B1
(45) Date of Patent: Mar. 6, 2001

(54) MULTIFUNCTION PRINTED-CIRCUIT ANTENNA

(75) Inventors: Philippe Dufrane, Limoges; Pascal Roy, Paris, both of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/433,309

(22) Filed: Nov. 3, 1999

(30) Foreign Application Priority Data

Nov. 4, 1998 (FR) ..... 98 13869

(51) Int. Cl.[7] ..... H01Q 1/38
(52) U.S. Cl. ..... 343/700 MS; 343/830
(58) Field of Search ..... 343/700 MS, 702, 343/830, 846

(56) References Cited

U.S. PATENT DOCUMENTS

| | | | |
|---|---|---|---|
| 4,072,952 | 2/1978 | Demko | 343/700 MS |
| 4,218,682 | 8/1980 | Yu | 343/700 MS |
| 5,003,318 | 3/1991 | Berneking et al. | 343/700 MS |
| 5,041,838 * | 8/1991 | Liimatainen et al. | 343/700 MS |

FOREIGN PATENT DOCUMENTS 0 362 079 4/1990 (EP) .

* cited by examiner

*Primary Examiner*—Don Wong
*Assistant Examiner*—James Clinger
(74) *Attorney, Agent, or Firm*—Oblon, Spivak, McClelland, Maier & Neustadt, P.C.

(57) ABSTRACT

The multifunction printed-circuit antenna is designed for the reception of radioelectric waves sent by the GPS, GLONASS and MLS radio navigation systems. It comprises first, second and third circular patches that are parallel to one another and superimposed in this order above one and the same ground plane that is parallel to them, the centers of the patches being aligned on one and the same axis z'z perpendicular to the plane of the three patches, the patches being separated from one another by thicknesses of a substrate-forming dielectric material for each of the patches. The first and second patches form, with the ground plane, the antenna structure for the reception of the GPS, GLONASS waves. The MLS antenna reception structure is formed by the third and second patches. The second patch also serves as a ground plane for the MLS antenna structure. The third patch of the MLS structure has a diameter smaller than that of the first and second patches of the GPS, GLONASS structure, and the surface dimensions of the dielectric substrate between the third and second patches are smaller than those of the first and second patches. Application to GPS/GLONASS, MLS antennas.

14 Claims, 3 Drawing Sheets

SECTION aa'

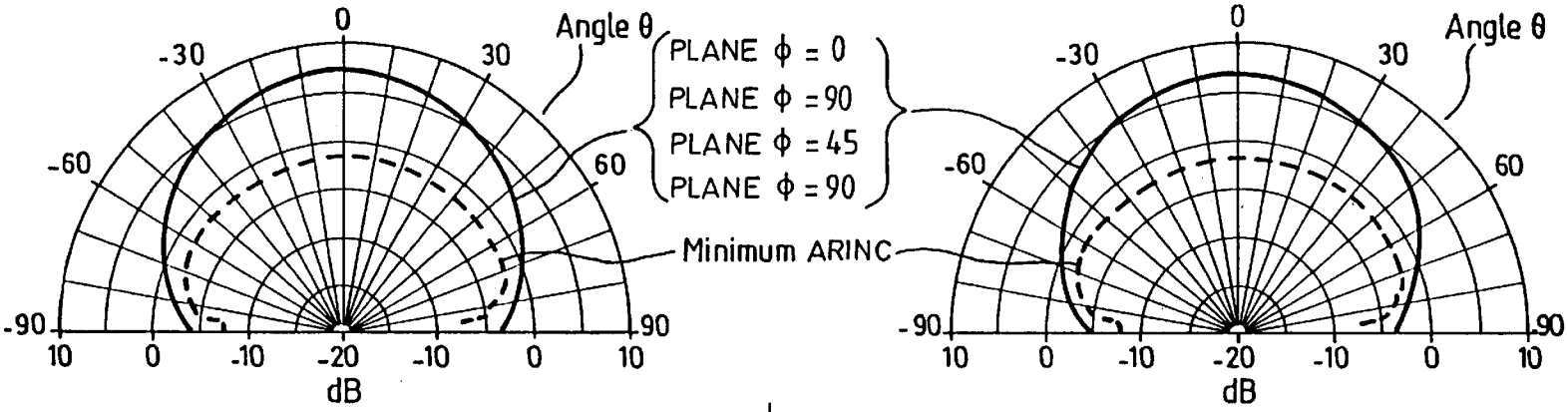
FIG.4a
FIG.4b
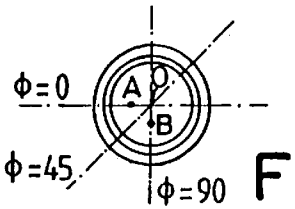
FIG.4c
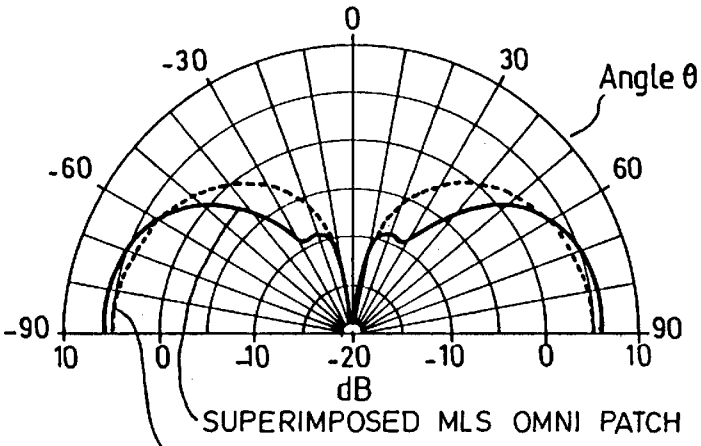
FIG.5

MULTIFUNCTION PRINTED-CIRCUIT ANTENNA

BACKGROUND OF THE INVENTION

1. Field of the Invention

The present invention forms part of the general framework of the combining of radioelectric functions in aircraft.

It can be applied especially to the making of an aircraft antenna according to the known technology of multilayer printed circuits combining, on the one hand, the functions of satellite localization of systems working in the L band of the radioelectric frequencies, known as the Global Positioning System or GPS L1 and the Global Navigation Satellite System or GLONASS and, on the other hand, the landing assistance function in the C band of radioelectric frequencies working in the Omni MLS or Microwave Landing System.

2. Description of the Prior Art

At present, the antennas related to these functions are distinct and have different technologies. If we consult the catalogs of the aeronautical antennas by RAYAN and M/A-Com, it can be seen that antennas designed for the MLS Omni system are "quarter-wave whip" type antennas while the radiating elements of the GPS L1 or GLONASS system are formed chiefly by monolayer microstrip structures of the printed-circuit patch type on substrates with high dielectric permittivity. Furthermore, when it is proposed to obtain the GLONASS function through the GPS antenna, its performance characteristics are not certified.

The aim of the invention is to overcome the above-mentioned drawbacks by proposing a single multilayer antenna structure that is very compact, adapted to aeronautical constraints and complies with the specifications of the GPS L1, GLONASS and Omni MLS functions when they are taken separately.

SUMMARY OF THE INVENTION

To this end, an object of the invention is a multifunction printed-circuit antenna for the reception of radioelectric waves sent by the GPS, GLONASS and MLS radio navigation systems, comprising first, second and third circular patches that are parallel to one another and superimposed in this order above one and the same ground plane that is parallel to them, the centers of the patches being aligned on one and the same axis z'z perpendicular to the plane of the three patches, the patches being separated from one another by thicknesses of a substrate-forming dielectric material for each of the patches, and wherein the first and second patches form, with the ground plane, the antenna structure for the reception of the GPS, GLONASS waves, the MLS antenna reception structure being formed by the third and second patches, the second patch also serving as a ground plane for the MLS antenna structure, the third patch of the MLS structure having a diameter smaller than that of the first and second patches of the GPS, GLONASS structure, and wherein the surface dimensions of the dielectric substrate between the third and second patches are smaller than those of the first and second patches and wherein it comprises a first ground wire connecting the centers of the first patch and of the second patch to the ground plane in a direction perpendicular to the ground plane, first and second output ports respectively connected at points of the first patch by metallized via holes through the thickness of the substrate which is interposed between the first patch and the ground plane and located at a determined distance d from the center of the first patch along two perpendicular directions x'x and y'y to produce in-phase quadrature signals on the first and second output ports and a second ground wire connecting the third patch, at a point located at a determined distance d' from the center of the third patch, to the second patch along a direction perpendicular to the ground plane, a third output port being connected by a metallized via hole to the center of the third patch through thicknesses of the substrates between the first, second and third patches.

An advantage of the invention is that it makes it possible, by means of one and the same radiating element constituted by a printed-circuit antenna with two superimposed circular patches, on identical substrates, to perform the functions of the GPS L1 and GLONASS systems with radioelectric reception performance characteristics that comply with the ARINC 743A standard. The invention also has the advantage of making it possible to obtain the Omni MLS function with only one circular patch printed-circuit antenna with central reception working in a higher mode, the TM020 mode, whose radiation is of the single pole type, thus enabling a combining of the radiating elements by superimposition.

BRIEF DESCRIPTION OF THE DRAWINGS

Other characteristics and features of the invention shall be seen in the following description made with reference to the appended drawings, of which:

FIGS. 4*a* and 4*b* show curves of gain of the antenna structure according to the invention to the 1572 MHz and 1628 MHz frequencies for the reception of the GPS L1 and GLONASS signals, FIG. 4*c* shows the angular directions Φ of the planes used for the recording of the gain values used to plot the curves of FIGS. 4*a* and 4*b*, FIG. 5 shows a gain curve of the MLS antenna structure of the invention.

MORE DETAILED DESCRIPTION

Figure 1:
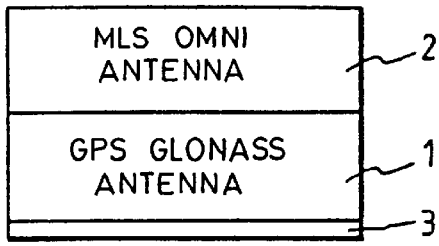
FIG. 1 is a figure in which a GPS L1, GLONASS antenna and an Omni MLS antenna are combined together.

The antenna according to the invention which is shown according to the schematic diagram of FIG. 1 consists of two superimposed antenna structures referenced 1 and 2 on top of the same ground plane 3.

The antenna structure 1 is suited to the reception of the L band signals of the GPS or GLONASS system while the antenna structure 2 is suited to the reception of the signals of the Omni MLS system.

Figure 2A:
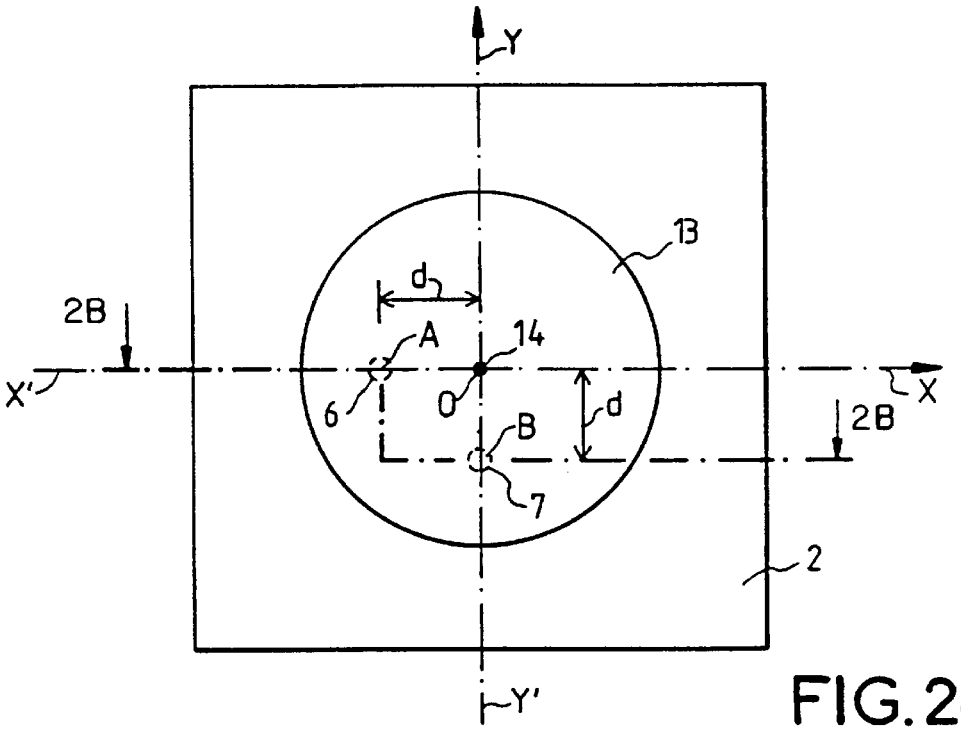
FIGS. 2*a* and 2*b* show an embodiment of an antenna adapted according to the invention to the reception of radioelectric waves from the GPS L1 and GLONASS systems.
Figure 2B:
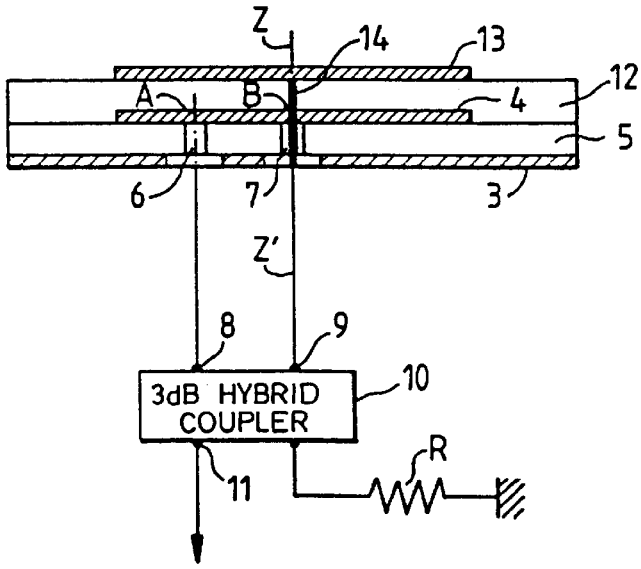

The antenna structure 1 is shown in FIGS. 2*a* and 2*b* in a top view and a profile view along the section aa'. It has a first patch consisting of a conductive film 4 deposited on the upper face of a dielectric substrate 5 whose lower face is parallel to the upper face and is entirely metallized to form a ground plane 3. The conductive film 4 has a circular shape in order to obtain a reception pattern with a symmetry generated by revolution.

The electromagnetic field received by the antenna inside the dielectric substrate is propagated according to the $TM_{100}$ and $TM_{001}$ resonance modes. Coaxial links connect output ports 6 and 7 to inputs 8 and 9 of an external 3 dB hybrid coupler 10. The output ports 8 and 9 are respectively connected to points A and B of the conductive film by metallized via holes through the thickness of the substrate 5. The points A and B are positioned respectively on two perpendicular axes x',x and y',y at one and the same distance d from the center 0 of the conductive film 4 to produce two in-phase quadrature signals. The sign of the phase shift between the two signals in quadrature determines the right-hand or left-hand direction of the polarization. The signals applied to the two inputs 8 and 9 of the hybrid coupler 10 emerge recombined as one and the same signal at the output 11 of the coupler 10. This coupler 10 is loaded in a known way by a matching resistor R.

To markedly reduce the thickness of the antenna when, for example, special conditions of aerodynamism are required, a second dielectric substrate 12 is placed above the first conductive film 4 and a second patch, in the form of a circular conductive film 13 centered on an axis z'z going through the center O of the conductive film 4 and perpendicular to the planes of the two conductive films 4 and 13, is deposited on the external surface of the second substrate 12 parallel to the first conductive film 4.

A ground wire 14 connects the center O of the film 4 to the ground plane 3 so as to provide for the efficient ground connection of the antenna with the equipment for which it is designed and so as not to disturb the $TM_{10}$ and $TM_{01}$ antenna reception modes, their electrical vertical component being zero at this point.

Figure 3A:
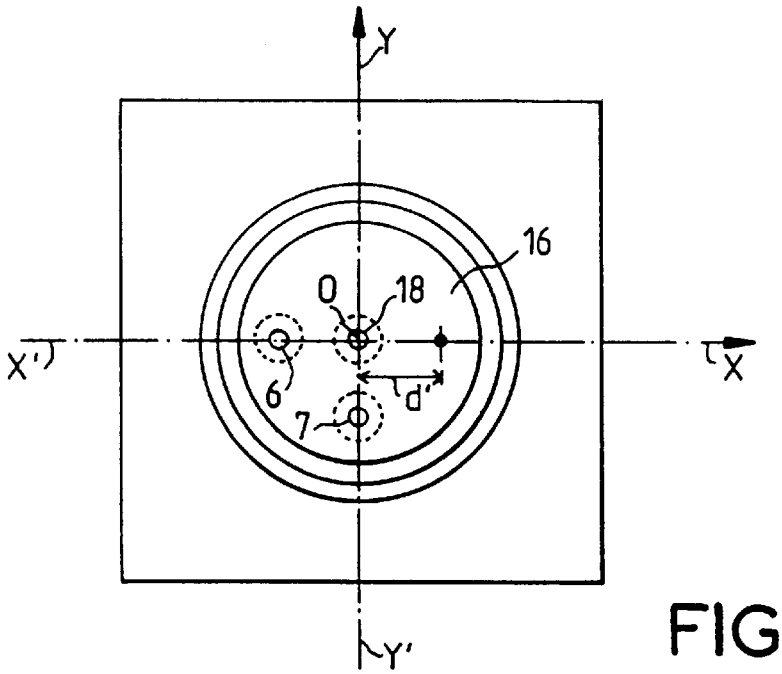
FIGS. 3*a* and 3*b* show the addition of an antenna structure adapted to the reception of radioelectric waves of the Omni MLS system.
Figure 3B:
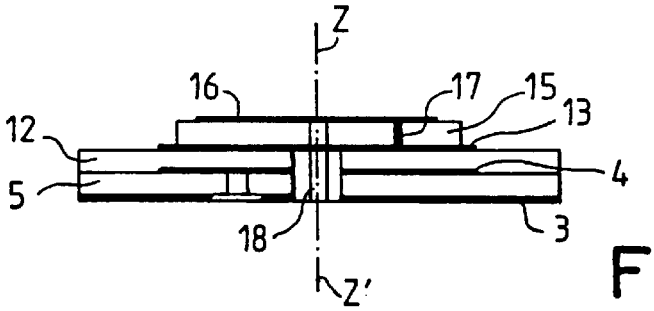

For the reception of the MLS signals, a third dielectric substrate referenced 15 in FIGS. 3*a* and 3*b* is placed above the conductive film 13 and a third patch in the shape of a circular conductive film 16 centered on the axis z'z is deposited on top of the dielectric substrate 15. In this configuration, the ground plane of the MLS antenna is constituted by the second conductive film 13. A ground wire 17 parallel to the axis z'z and at a distance d' from it connects the third conductive film 16 to the second conductive film 13 through the dielectric substrate 15. The MLS signal is recovered by a coaxial connector that gets engaged into a metallized via hole 18 connecting the center of the conductive film 16 through the thickness of the three substrates 5, 12 and 15.

In this embodiment, it is important that the diameter of the conductive film 16 forming the third patch should be smaller than the diameters of the conductive films of the other two patches and that the surface dimensions of the dielectric substrate 15 interposed between the second and third patches 13 and 16 should be smaller than those of the conductive film of the patches 4 and 13.

Figure 6:
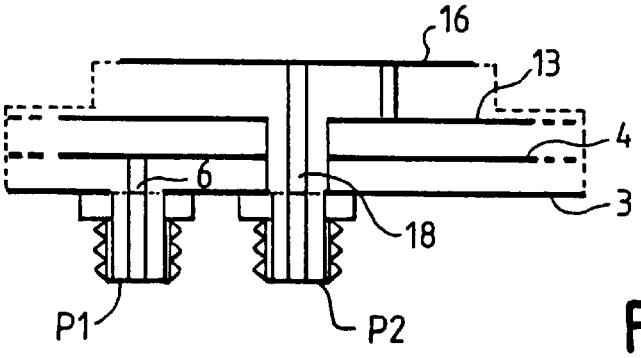
FIG. 6 is a last embodiment of the antenna according to the invention provided with coaxial connectors for the conveyance of the detected signals towards reception circuits.

FIG. 6 shows the antenna according to the invention provided with coaxial connectors P1, P2 and P3 for the connection of the metallized holes 6, 7 and 18 to external reception circuits. In this FIG. 6, the elements similar to those of FIGS. 3*a* and 3*b* are identified by the same references. This arrangement enables the ground wire 14 to be linked by the external conductor of the coaxial link.

As an indication, to obtain satisfactory operation of the antenna system according to the invention both in the L band of reception of the GPS L1, GLONASS signals and in the C band of reception of the Omni signals, the following dimensions may be adopted:

Thickness of the first substrate: $h_1$=3.2 mm

Thickness of the second substrate: $h_2$=3.2 mm

Thickness of the third substrate: $h_3$=4.45 mm

Total thickness: h=11 mm

Dielectric constant $\epsilon$=3.2 for all three substrates with a value of 0.0025 for the loss tangent of dielectric.

Diameter of the first conductive film 4, $\phi_1$=56.5 mm.

Diameter of the second conductive film 13: $\phi_2$=56.5 mm.

Diameter of the third conductive film 16: $\phi_3$=56.5 mm

Distance d=16 mm

Distance d'=10 mm

This device makes it possible to obtain radiation patterns of the GPS L1, GLONASS function achieved with the structure of FIGS. 2*a* and 2*b* that are not disturbed by the presence of the MLS structure and meet the ARINC standard. As can be seen in FIGS. 4*a* and 4*b*, the gain of the GPS L1, GLONASS structure at the 1572 MHz and 1628 MHz frequencies remains far greater than the minimum gain required by the ARINC standard in all the directions of the plane shown in FIG. 4*c*, having in common the axis z'oz, the original plane being the one containing the axis x'ox. The radiation pattern of the MLS structure shown in FIG. 5 however appears to be modified as compared with the one given by a quarter-wave whip antenna by a valuable increase in the gain on the horizon at plus or minus 90° and the appearance of two hollows at the elevation angles at plus or minus 30°. This behavior can be explained by the elevation at the phase center of the MLS antenna which produces an "array" effect that deforms the patterns.

It must be noted that by using greater dielectric thicknesses leading to a total thickness h greater than 11 mm, greater deformations of the radiation pattern are obtained with a marked drop in the gain on the horizon.

What is claimed is:

1. A multifunction printed-circuit antenna for the reception of radioelectric waves sent by the GPS, GLONASS and MLS radio navigation systems, comprising first, second and third circular patches that are parallel to one another and superimposed in this order above one and the same ground plane that is parallel to them, the centers of the patches being aligned on one and the same axis z'z perpendicular to the plane of the three patches, the patches being separated from one another by thicknesses of a substrate-forming dielectric material for each of the patches, and wherein the first and second patches form, with the ground plane, the antenna structure for the reception of the GPS, GLONASS waves, the MLS antenna reception structure being formed by the third and second patches, the second patch also serving as a ground plane for the MLS antenna structure, the third patch of the MLS structure having a diameter smaller than that of the first and second patches of the GPS, GLONASS structure, and wherein the surface dimensions of the dielectric substrate between the third and second patches are smaller than those of the first and second patches and wherein it comprises a first ground wire connecting the centers of the first patch and of the second patch to the ground plane in a direction perpendicular to the ground plane, first and second output ports respectively connected at points of the first patch by metallized via holes through the thickness of the substrate which is interposed between the first patch and the ground plane and located at a determined distance d from the center of the first patch along two perpendicular directions x'x and y'y to produce in-phase quadrature signals on the first and second output ports and a second ground wire connecting the third patch, at a point located at a determined distance d' from the center of the third patch, to the second patch along a direction perpendicular to the ground plane, a third output port being connected by a metallized via hole to the center of the third patch through thicknesses of the substrates between the first, second and third patches.

2. An antenna according to claim 1, wherein the link constituted by the first ground wire is formed by the external conductor of a coaxial link.

3. An antenna according to either of the claims 1 or 2, having a total thickness of less than 11 mm.

4. A multifunction printed-circuit antenna for reception of radioelectric waves, comprising:

a ground plane;

a first conductive patch parallel to said ground plane and separated from said ground plane by a first dielectric layer;

a second conductive patch parallel to said first conductive patch and separated from said first conductive patch by a second dielectric layer;

a first and second output ports connected to said first conductive patch at points positioned so that said first and second output ports output two in-phase quadrature signals within a first band of radioelectric frequencies;

a first ground connector configured to connect said first and second conductive patches to said ground plane;

a third conductive patch parallel to said second conductive patch and separated from said second conductive patch by a third dielectric layer, said first, second and third conductive patches having geometric centers aligned on an axis perpendicular to said ground plane;

a coaxial connector connected to said third conductive patch and configured to transmit signals within a second band of radioelectric frequencies, and a second ground connector configured to connect said third conductive patch to said second conductive patch.

5. The multifunction printed-circuit antenna of claim 4, wherein said first, second and third conductive patches have a circular shape.

6. The multifunction printed-circuit antenna of claim 4, wherein said first ground connector comprises a wire connecting said geometric centers of said first and second conductive patches in a direction perpendicular to said ground plane.

7. The multifunction printed-circuit antenna of claim 4, wherein said first and second output ports are connected to said first conductive patch by metallized via-holes through said first dielectric layer.

8. The multifunction printed-circuit antenna of claim 4, wherein said points are positioned respectively on two perpendicular axes and at a same distance from the geometric center of said first conductive patch.

9. The multifunction printed-circuit antenna of claim 4, wherein said coaxial connector is engaged into a metallized via-hole connecting the center of said third conductive patch through said first, second and third dielectric layers.

10. The multifunction printed-circuit antenna of claim 9, wherein said second ground connector comprises a ground wire perpendicular to said ground plane and connected to said third conductive patch at a distance from the center of said third conductive patch.

11. The multifunction printed-circuit antenna of claim 5, wherein said third conductive patch has a diameter smaller than the diameters of said first and second conductive patches.

12. The multifunction printed-circuit antenna of claim 11, wherein said third dielectric layer has surface dimensions smaller than the surface dimensions of said first and second dielectric layers.

13. The multifunction printed-circuit antenna of claim 4, wherein said first ground connector comprises an external conductor of said coaxial connector.

14. The multifunction printed-circuit antenna of claim 4, wherein said first band of radioelectric frequencies corresponds to the L band of radioelectric frequencies, and said second band of radioelectric frequencies corresponds to the C band of radioelectric frequencies.

* * * * *